US010456700B2

(12) United States Patent
Mileto

(10) Patent No.: US 10,456,700 B2
(45) Date of Patent: Oct. 29, 2019

(54) SNOWMAN MAKING APPARATUS

(71) Applicant: Giuseppe Mileto, Tottenham (CA)

(72) Inventor: Giuseppe Mileto, Tottenham (CA)

( * ) Notice: Subject to any disclaimer, the term of this patent is extended or adjusted under 35 U.S.C. 154(b) by 199 days.

(21) Appl. No.: 15/364,302

(22) Filed: Nov. 30, 2016

(65) Prior Publication Data

US 2017/0266575 A1 Sep. 21, 2017

Related U.S. Application Data

(60) Provisional application No. 62/309,588, filed on Mar. 17, 2016.

(30) Foreign Application Priority Data

Aug. 12, 2016 (GB) ..... 1613869.5

(51) Int. Cl.
*A63H 33/00* (2006.01)
*A63H 3/16* (2006.01)

(52) U.S. Cl.
CPC ..... *A63H 33/001* (2013.01); *A63H 3/16* (2013.01)

(58) Field of Classification Search
CPC ..... A63H 3/16; A63H 33/001
See application file for complete search history.

(56) References Cited

U.S. PATENT DOCUMENTS 3,836,308 A * 9/1974 Upright ..... A63H 33/001 220/4.21
7,963,500 B1 * 6/2011 Holiday ..... B29C 39/02 249/117

* cited by examiner

*Primary Examiner* — James Sanders

(57) ABSTRACT

A snowman making apparatus having a hemi-spherical bowl element, wherein the bowl element has an open top, and an aperture at a base of the bowl element to facilitate collection of snow in the bowl element, via dragging the bowl element over a surface of snow. In a preferred embodiment, the snowman making apparatus comprises three bowl elements of differing sizes, for making a snowman comprising a base segment; a mid-section segment; and a head segment, of different sizes.

9 Claims, 5 Drawing Sheets

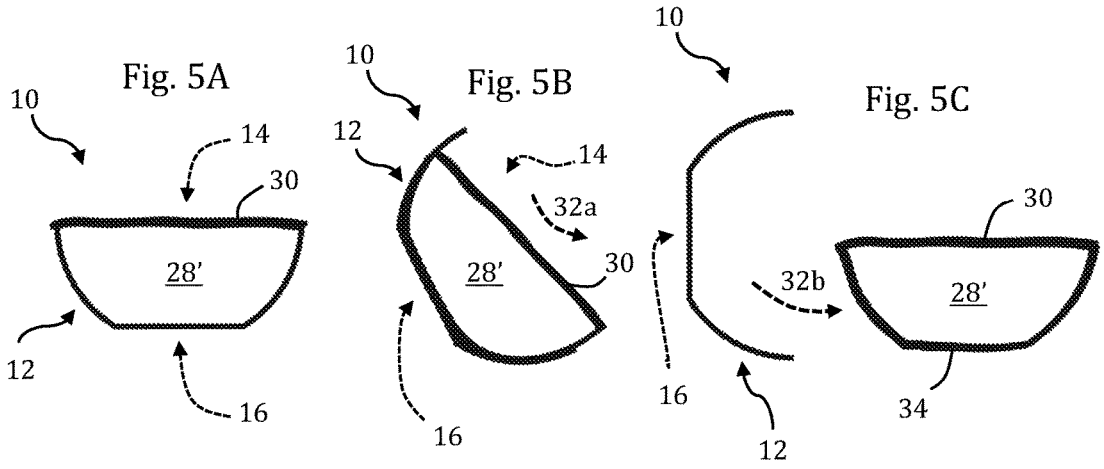
Fig. 5A
10
14
30
28'
12
16
Fig. 5B
10
12
14
32a
28'
30
16
Fig. 5C
10
30
32b
28'
16
12
34
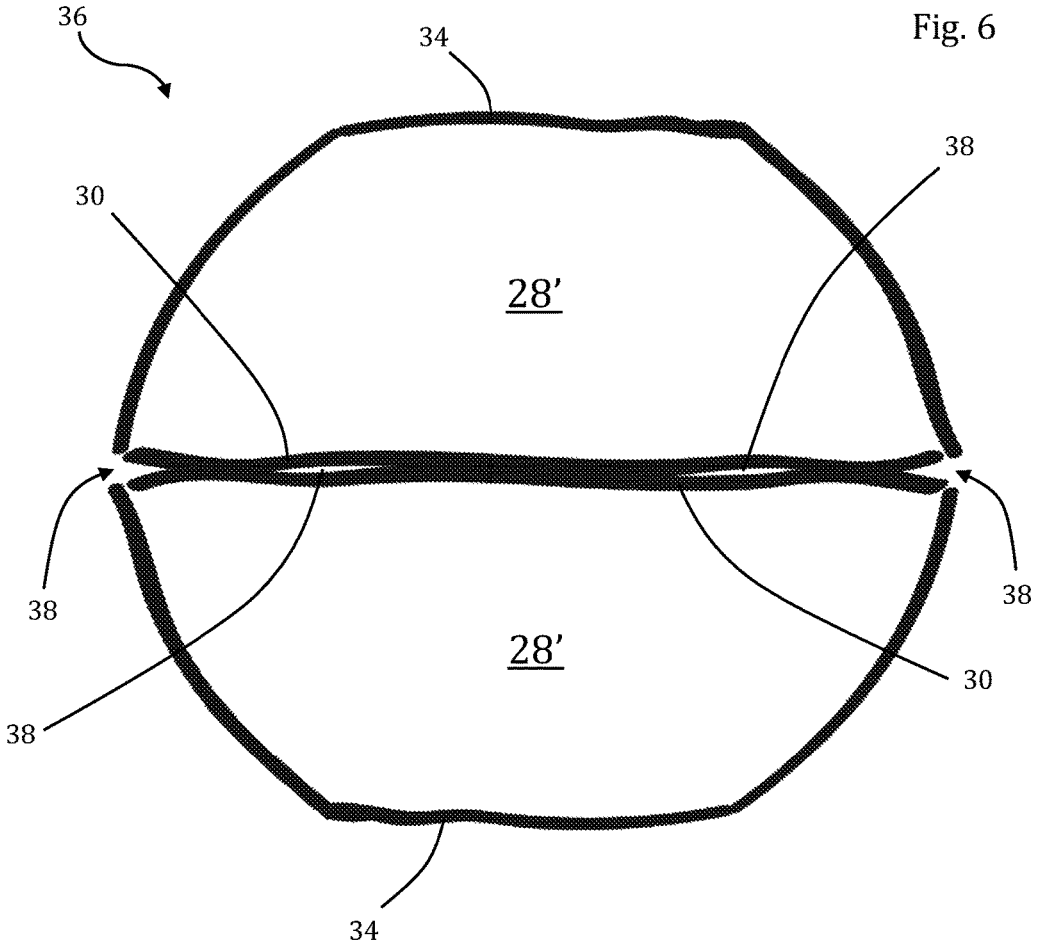
Fig. 6
36
34
38
30
28'
38
38
28'
30
38
34

SNOWMAN MAKING APPARATUS

The present invention relates to an apparatus to help make a snowman.

BACKGROUND

In places where it has snowed, making a snowman out of snow is a past-time that is often enjoyed by children.

However, without any helpful aids, it can take a long time, and a lot of energy, to make a snowman, and this often prevents kids from getting started in the first place. In an age where young kids can get instant entertainment from media devices such as smart phones and computers, this is even more of a problem, and has led to even less kids spending time outside, making snowmen. Instead, they often stay indoors, perhaps playing or interacting on media devices.

To give further background/information, snow will tend not to stick or pack together if it doesn't have moisture and is dry. The snow will also tend not to pack properly if very cold, such as below minus two degrees Celsius. A good snowman building temperature tends to be anywhere from minus two degrees to plus two degrees Celsius. It can be very challenging, if not impossible, to build symmetrical snow ball(s) without such proper snow temperature. Even if the snow is at the proper snowman building temperature, it can still be challenging to build symmetrical snowball sphere(s) (eg three snowman segments) that preferably look like a classic snowman. This, when making a snowman, can lead to children and/or adults getting frustrated and/or disappointed, which may lead to them thus not attempting to go outdoors, in knowing the cold conditions.

It would be desirable if there were a fun (and quick) way to make a snowman, which would get more children to play outside in the snow (which is good for their health and wellbeing), rather than staying indoors. It could also provide some exercise.

SUMMARY

The present invention is defined by the accompanying claims, to which reference should now be made.

Examples of the present invention seek to provide a solution to any or all of the above problem(s) by providing, according to a first aspect: a snowman making apparatus, comprising: a substantially hemi-spherical bowl element; wherein the bowl element has an open top, and an aperture at a base of the bowl element to facilitate collection of snow in the bowl element, via dragging the bowl element over a surface of snow.

Preferably the apparatus comprises a set of three said bowl elements (of differing sizes), to create a snowman with different sized 'segments' (eg base, mid-section, and head segments).

The apparatus provides a fun (and very quick) way to make a snowman. It could also be said that the apparatus 'templatizes' the making of a perfect snowman.

In one preferred embodiment the apparatus may comprise four said bowl elements, which may allow for two different sizes of three-segment snowmen to be made. This could be useful to allow children (or any user(s)) to make a smaller version snowman.

U.S. Pat. No. 6,176,464 (B1) (HARVEY) discloses an invention to help make a snowman, wherein circular members are stacked on top of each other, and snow is then deposited into a hole at a top of the member arrangement, to fill them with snow. The circular members can then be removed. There are no apertures at the base of the circular members, and snow is not collected into the circular members by dragging them over a surface of snow. The circular members are generally fully spherical, rather than substantially hemi-spherical. HARVEY teaches a wholly different invention and method/technique for how to make a snowman.

U.S. Pat. No. 7,963,500 (B1) (HOLIDAY) discloses an arrangement similar to HARVEY, comprising hollow plastic circular members, which seem to have an aperture at a top of the circular member and can be connected together, and filled with snow. It seems it is intended that the circular members are retained around the snow, even when the snowman is built, since the members can have apertures for receiving snowman accessories such as mouth, nose etc. Again, HOLIDAY teaches a very different invention and method/technique for making a snowman.

One of the benefits the disclosure of the present application has over the prior art mentioned is its extreme simplicity, as well as how little space it takes up.

According to a second aspect of the invention, examples of the second aspect seek to provide a solution by providing: a method of making a snowman, comprising: filling a substantially hemi-spherical bowl element with snow, thus creating a first substantially hemi-spherical sphere of collected snow in the bowl element; releasing the first substantially hemi-spherical sphere of collected snow out of the bowl element; filling the substantially hemi-spherical bowl element with snow again, thus creating a second substantially hemi-spherical sphere of collected snow in the bowl element; releasing the second substantially hemi-spherical sphere of collected snow out of the bowl element; placing one of the substantially hemi-spherical spheres of collected snow, faced downwards, on top of the other substantially hemi-spherical sphere of collected snow, the other substantially hemi-spherical sphere of collected snow being faced upwards, thus creating a substantially spherical snowman segment.

Preferably the first substantially hemi-spherical sphere of collected snow is released, faced upwards, and the second substantially hemi-spherical sphere of collected snow, having been released, is placed downwards, on top of the first substantially hemi-spherical sphere of collected snow.

Preferably there are provided a plurality of bowl elements, of differing sizes, to create different sized snowman segments. Most preferably, there are provided three said bowl elements of differing sizes, to create a base segment of a snowman; a mid-section segment; and a head segment of the snowman. The method thus preferably also comprises stacking multiple snowman segments on top of each other, to create a snowman.

The method (unlike the first aspect) does not require that the bowl element(s) comprise an aperture at a base of the bowl element(s). The bowl element(s) may be filled with snow in any way, such as simply by placing snow into them. The method may be afforded any of the feature(s) and/or disclosure and/or step(s) disclosed with reference to the first aspect, which feature(s) and/or disclosure and/or step(s) may be provided as essential or preferable and/or optional features of the second aspect (i.e. method).

BRIEF DESCRIPTION OF THE DRAWINGS

Examples of the present invention will now be more particularly described, with reference to the accompanying drawings, by way of example only, in no way limiting a scope of the invention, in which:

FIG. 5A is a cross sectional view of a said bowl element, showing snow collected into a substantially hemi-spherical shape inside the bowl element;

FIG. 5B is a cross sectional view of the example of FIG. 5A, showing the bowl element being tipped, and the snow collected in the bowl element sliding out of the bowl element;

FIG. 5C shows the same example of FIGS. 5A and 5B, showing the snow having been tipped out of the bowl element, and now forming a substantially hemi-spherical shape;

FIG. 6 is a side view of a snowman segment, showing how the bowl element (especially in light of what is shown in FIGS. 5A, 5B, and 5C) can be used to make a snowman segment;

DETAILED DESCRIPTION

Figure 1:
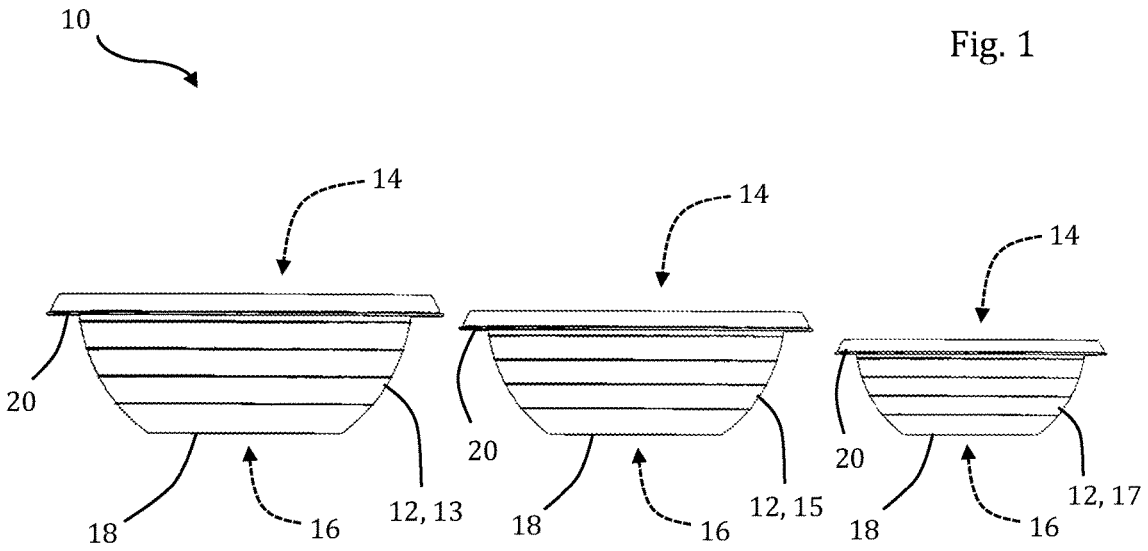
FIG. 1 shows a side view of a preferred embodiment of a snowman making apparatus, in accordance with what is claimed, wherein the apparatus comprises three bowl elements.

Referring to the drawings, there is shown a snowman making apparatus 10, comprising: a substantially hemi-spherical bowl element 12; wherein the bowl element 12 has an open top 14, and an aperture 16 at a base 18 of the bowl element 12 to facilitate collection of snow in the bowl element 12, via dragging the bowl element 12 over a surface of snow.

The term 'substantially hemi-spherical' does not mean the bowl element(s) has to be exactly hemi-spherical, but that it is generally hemi-spherical in shape. For example, as will be shown, in the preferred embodiments shown, the aperture at the base of the bowl element(s) means that it is not exactly hemi-spherical. However, it is generally hemi-spherical in shape, which will be shown to be important, particularly with reference to FIGS. 5A, 5B, 5C and FIG. 6, which shows the bowl element(s) being used to form a snowman segment.

The bowl element(s) are preferably made out of plastic, and are preferably lightweight (e.g. made out of lightweight plastic), but may be made out of any material.

Preferably the or each bowl element comprises a handle, which helps handling of the bowl element by a user. This can be particularly useful to help the user drag the bowl element across a snow surface and/or to lift and/or tilt the bowl element (which can be important, as will be shown).

In the example preferred embodiments shown, the handle is provided by way of (i.e. comprises) a rim 20 about an edge of the bowl element. Thus the edge of the bowl element is shown comprising a rim 20. A rim 20, however, is just one example of a handle, and any handle arrangement may be provided (e.g. an extension, that extends from the bowl element, similar to how a handle of a hair brush extends).

As shown the rim 20 preferably extends round a whole circumference of the bowl element. Whilst the rim 20 is shown in many of the Figures, it is best shown in the perspective up-turned view of the bowl element, in FIG. 3.

Preferably there is provided a support arrangement for supporting the rim 20. This could be useful as the bowl element may, potentially, become heavy when filled with (possibly compacted) snow. A support arrangement, to support the rim, may thus be useful. It may, for example, stop the rim from breaking (e.g. snapping) if a user tries to tilt or lift the bowl element, whilst holding the rim. It may also prevent the rim from turning inside out (which an unsupported plastic rim could do), e.g. when the bowl element is tilted and/or lifted, when full of snow.

The example support arrangement (best shown in FIG. 3) comprises four support features 22. (Three of the support features are visible, with the other not visible due to the body of the bowl element obscuring it). Thus, in the example, there are four support features, spaced at regular ninety degree intervals around the bowl element/rim. However, a support arrangement may comprise one, or any amount of support features. It can be seen how the support features provide added strength to the rim 20.

In a preferred embodiment, the apparatus comprises a plurality (i.e. more than one) of the said bowl elements, of different sizes. Thus there may, for example, be two said bowl elements, of differing sizes. This can facilitate making different sized snowman segments. In a particularly preferred embodiment, the apparatus comprises three said bowl elements of different sizes. Examples of this are shown in many of the Figures. However, the best Figure to denote the potential usefulness of this is FIG. 7, where it is shown how the three bowl elements, of differing sizes, can be used to create a snowman that comprises three segments of differing sizes.

In one preferred embodiment, the apparatus comprises a further fourth smaller bowl element. This can be seen in FIG. 9.

The apparatus may further comprise one or a plurality of snowman accessories. This is best shown in FIG. 8 (and FIG. 7).

As shown, the aperture 16 (i.e. hole/opening) at the base of the bowl element(s) is preferably centrally located on the base. This is best shown in FIG. 2, wherein the apertures 16 of the bowl elements shown are all located centrally.

Figure 2:
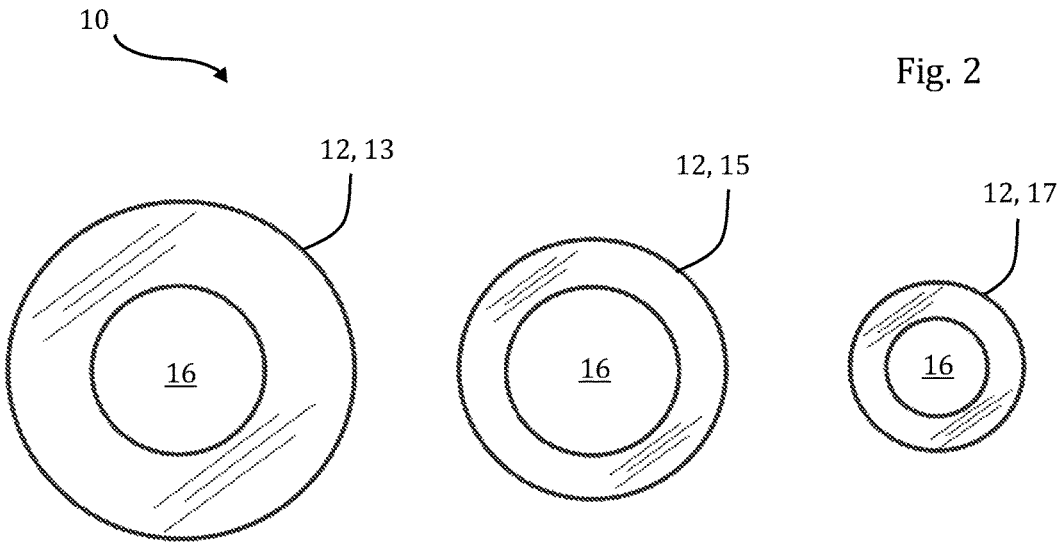
FIG. 2 shows the same embodiment as FIG. 1, from a top view, showing an aperture at a base of each said bowl element.

As shown in FIG. 2, in the preferred embodiment (wherein there are provided a plurality of bowl elements, and the apparatus preferably comprises three bowl elements), two bowl elements of differing sizes (e.g. bowl element 12, 13 and bowl element 12, 15) may have an aperture 16 of substantially the same size (i.e. the same size, or the same size to several centimeters or so). This may be beneficial (particularly in an embodiment wherein the apparatus 10 comprises three bowl elements) as the joining area between the snowman segments created with the two different sized bowl elements may be stronger/more stable. This will become obvious in light of when the apparatus is described in use.

Figure 3:
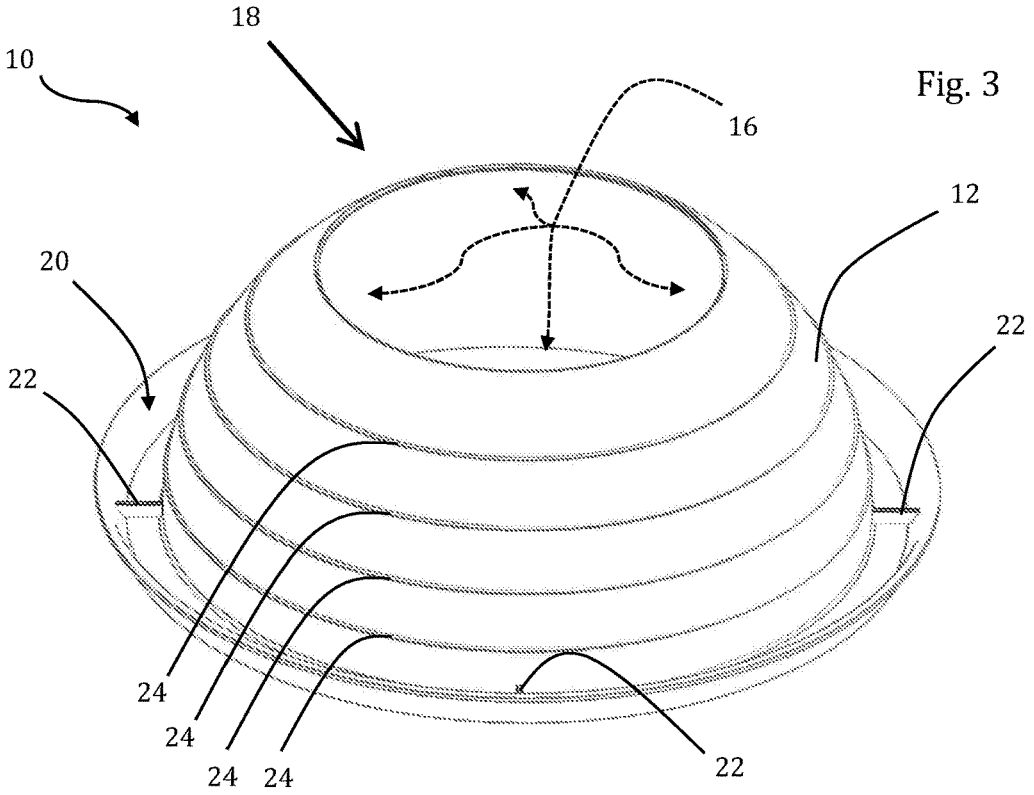
FIG. 3 is a perspective view of a said bowl element, upside down, showing the aperture at the base, and showing an example support arrangement for a rim of the bowl element.

It will be obvious the bowl element(s) 12 (especially if large), may take in a large amount of (possibly compacted)

snow, and may thus take on a heavy load/weight. The bowl element(s) 12 may thus be ribbed, to add structural strength to the bowl element. This may be particularly useful in embodiments that are made out of (preferably lightweight) plastic(s), which may be liable to bend, or break/fail. Thus the bowl element of FIG. 3 is shown comprising a rib arrangement. The rib arrangement is shown comprising a plurality of ribs 24, although it is feasible one, or any number of ribs 24 may be provided. In the example, the ribs 24 circumnavigate the bowl element 12. The example rib arrangement may be defined as concentric, although any arrangement may be provided. (The example ribs 24 are also shown on bowl elements in FIGS. 1, 7, and 9, although the ribs/ribbing is not numbered in those Figures).

In Use

An example(s) will now be described in use, described by way of example only, referring to a particularly preferred embodiment, and in no way limiting a scope of the invention. (The example will be described particularly with reference to FIGS. 4, 5A, 5B, 5C, and FIG. 6, which generally show a sequence of how a snowman segment can be made).

Figure 4:
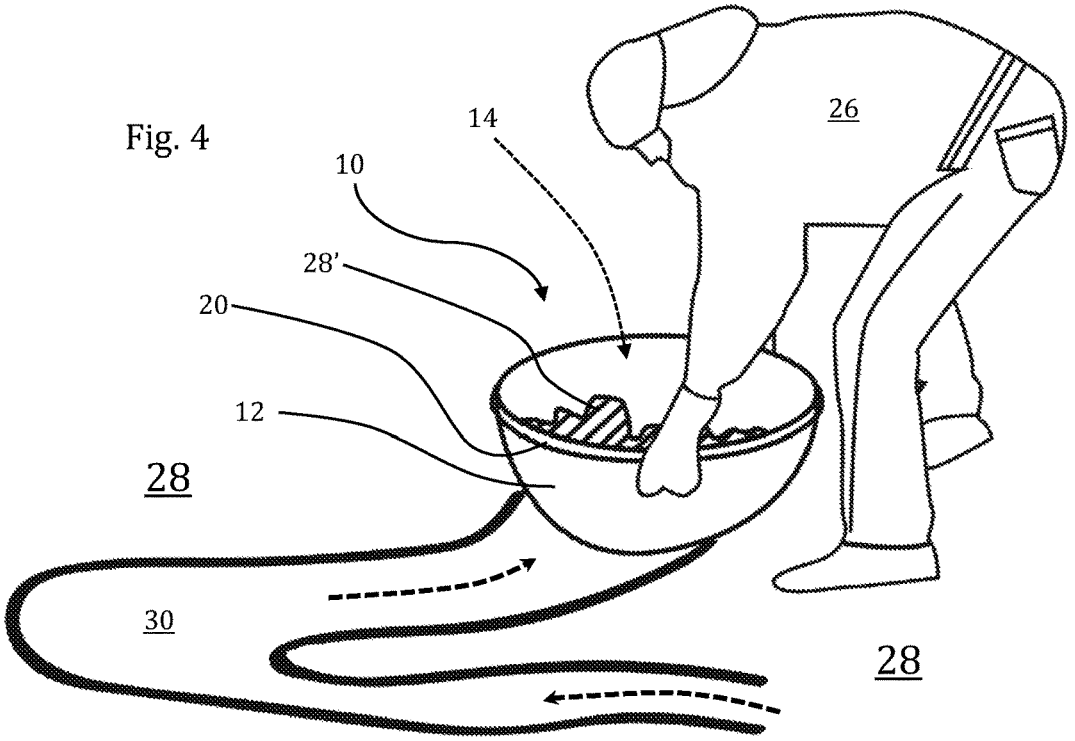
FIG. 4 shows the bowl element, in use, with a user dragging the bowl element across a surface of snow, which is collecting snow in the bowl element, through the aperture at the base of the bowl element.

Thus, referring in use (by way of example) to a particularly preferred example, there is shown in FIG. 4 an example of a user 26 using the apparatus 10. The user is shown grabbing the bowl element 12 (which in the preferred embodiment example is a large size bowl element 12, 13) by the handle 20, which, in the preferred embodiment shown, is provided by way of (i.e. comprises) the rim 20. This helps the user grab hold of, and drag, the bowl element 12.

There is shown (or denoted) a large amount of snow 28 on the ground surface. The user is shown (outside), dragging the bowl element along the ground surface of snow. Dragging the bowl element has created a trail 30 in the snow. Dashed arrows added at the start and end of the trail denote the general path the bowl element has been dragged, creating the trail 30.

As the bowl has been dragged, creating the trail, snow 28' has entered through the aperture 16 at the base 18 of the bowl element, and has thus collected in the bowl element. This takes very little work from the user. The aperture 16, in the shown depiction of FIG. 4, is not visible, but the collected snow 28' is clearly visible, having risen through the aperture 16.

Additional snow can be deposited (e.g. by hand) into the bowl element through the open top 14, if desired/required. The collected snow 28' is preferably then compacted (e.g. by patting it down manually). If the snow 28' is too cold, or too dry, water can be added to the snow, e.g. via the use of a spray bottle (which may also be provided). The water can bind the snow 28' and make it easy to release the snow from the bowl element. Water can be added for any reason, and may, for example, aid handling of the snow, and/or make the snow set better.

It will be obvious that, on occasion, it is feasible a user may simply fill the bowl element(s) by inputting snow into the top surface (e.g. manually). Therefore it is not required that the user always collect snow in the bowl element 12 by dragging the bowl element(s), thus using the aperture 16 at the base 18 of the bowl. Nevertheless, dragging the bowl element in such a way (thus collecting snow in the bowl element, via the aperture 16) can dramatically speed up how quickly the bowl element can be filled.

Referring now to FIG. 5A, FIG. 5A is a cross sectional view of the bowl element (e.g. a bowl element as used in FIG. 4), with snow having been fully collected in the bowl element. An upper surface 30 of the collected snow 28' is labeled. The bowl element is now full of collected snow 28' and the collected snow 28' is now seen forming a substantially hemi-spherical shape. The snow may have been patted down and thus compacted, by the user(s), to facilitate creation of a tight substantially hemi-spherical shape as seen. This may also flatten the upper surface 30.

FIG. 5B shows one way of releasing the collected snow 28' from the bowl element, via tilting the bowl element. Thus the bowl element 12 is shown tilted, and it can be seen, via the tilting, the collected snow 28' is sliding out of the bowl element. Preferably an inside of the bowl element(s) is smooth, to help the collected snow slide out of (and/or be released from) the bowl element(s). Arrow 32*a* denotes the trajectory of the collected snow 28' as it is sliding out. The tilting may be done by a user(s), manually, or via any other means. Tilting is just one method of how to release the collected snow 28' from the bowl element, but any other method of releasing the snow may be used.

FIG. 5C shows the collected snow 28', having been fully released from the bowl element 12 (which is seen fully tilted). Arrow 32*b* denotes trajectory of the collected snow as it has slid out of the bowl element 12. The collected snow 28' is shown clearly in a substantially hemi-spherical shape (albeit in cross-section). It is shown facing up (with the upper surface 30 facing up).

The example also shows (denoted in FIG. 5C clearly) how the aperture 16 of the bowl element, in the example, has created a flat lower surface 34 of the substantially hemi-spherical shape collected snow 28'.

Referring to FIG. 6, there is shown an example of a snowman segment 36 that can be/has been made using the apparatus 10. The collected snow 28' (as shown in FIG. 5C) is shown at a bottom half of the segment. This creates what may be termed a 'bottom' segment-half. However, the same process has been repeated (creating another substantially hemi-spherical shape of collected snow), which has been placed, upside down, on top of the lower substantially hemi-spherical shape of collected snow. This top, upturned portion may be termed a 'top' segment-half. When the top segment-half is placed on the bottom segment-half, upside down, it creates the snowman segment 36.

The top segment-half may be released from the bowl element in exactly the same way as the bottom segment-half (as shown in FIGS. 5A, 5B and 5C). It may then be lifted (by a user(s), for example), and upturned for placing, upside down, on the bottom segment-half. Alternatively, it is feasible the top segment-half is released from the bowl, mid-air, and placed upside down on the bottom segment-half. This may be challenging if the segment-half is heavy. Any release and/or positioning method may be used.

It is shown how, when mated in such a way, the two segment-halves form the snowman segment 36.

Where the upper surface 30 of the top-segment half (which is upside down, and therefore facing downwards) and the upper surface 30 of the bottom segment-half meet, there are shown, around the periphery of where the two halves meet, some portions 38 where there are slight gaps and/or overlaps and/or imperfections, where the two half-segments do not meet perfectly to form a perfect looking circle/sphere. These can be patted down (e.g. by the user(s)) to make the halves look perfectly joined smoothed) and/or snow (from the surrounding area, for example) can be used to fill these gaps.

Figure 7:
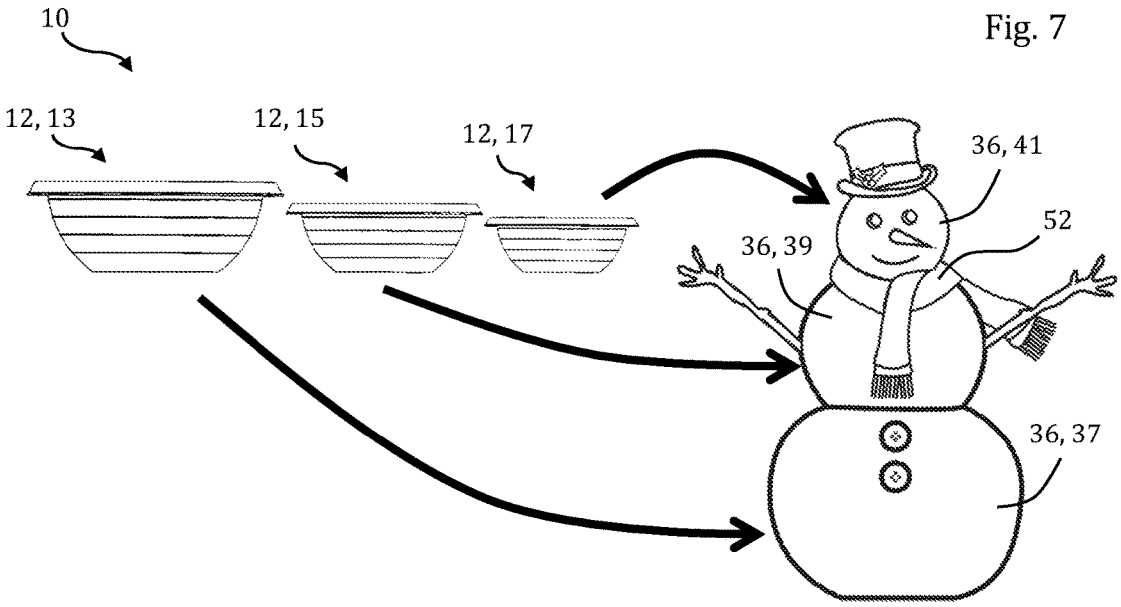
FIG. 7 shows a preferred embodiment of the apparatus, comprising three said bowl elements of different sizes, and denoting how they can be used to form a snowman which has segments of different sizes.
Figure 8:
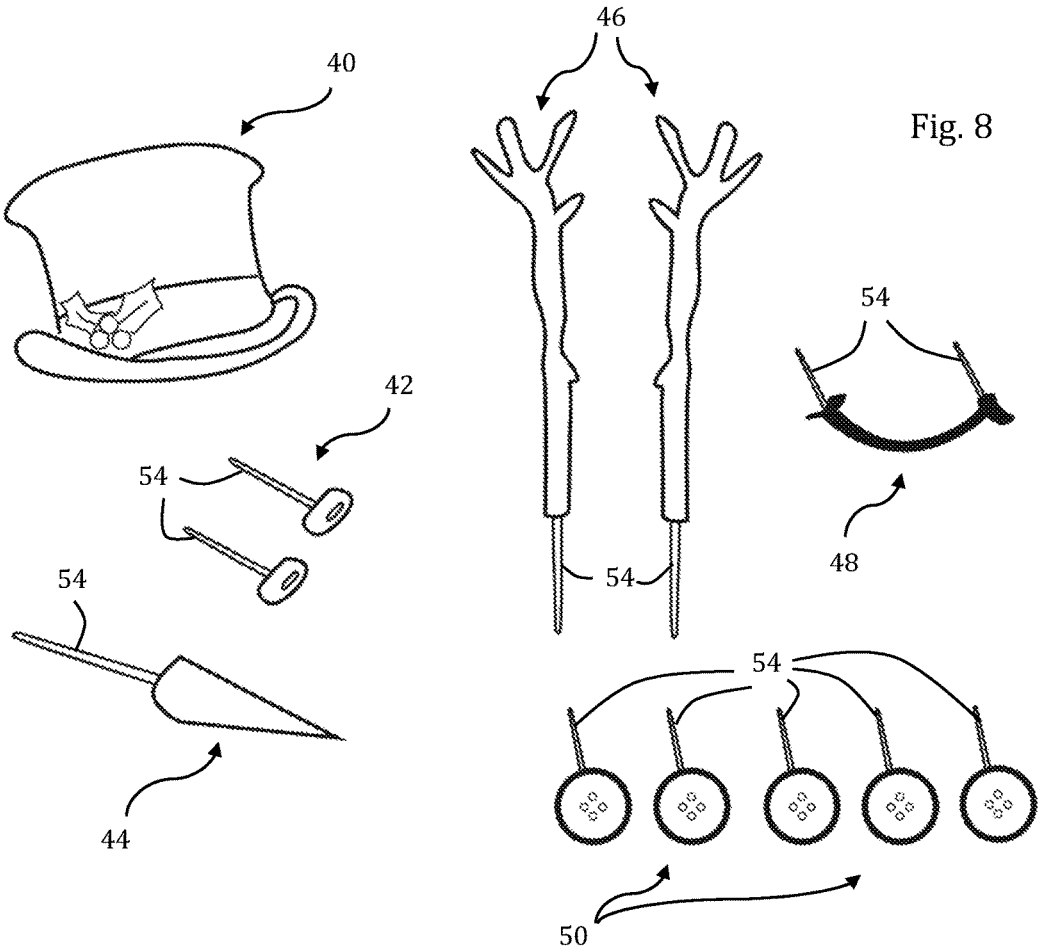
FIG. 8 shows an assortment of snowman accessories that may be provided, and which can be placed on a snowman made with the apparatus/bowl element(s)

With reference to FIG. 7, it is shown how, in a preferred embodiment of the apparatus 10, wherein the apparatus comprises three bowl elements 12 of differing sizes, how the different bowls can be used to make a snowman comprising three segments, of differing size, (using the same method as shown in FIGS. 5A, 5B, 5C and FIG. 6). Arrows denote that the largest bowl element 12, 13 has been used to make the biggest, base segment 36, 37 of the snowman; the middle-sized bowl element 12, 15 has been used to make the mid-section segment 36, 39 of the snowman; and the smallest bowl element 12, 17 has been used to make the head segment 36, 41 of the snowman.

The mid-section segment 36, 39 of the snowman is stacked on the base segment 36, 37 of the snowman, and the head segment 36, 41 of the snowman is stacked on the mid-section 36, 39 of the snowman. It can now be seen why the apertures 16 of the largest bowl element 12, 13 and middle-sized bowl element 12,15 being substantially the same size (as shown in FIG. 2) may be of benefit—it creates a flat lower surface 34 (faced upwards) of the top segment-half of the base segment 36, 37 of the snowman, and a flat lower surface 34 of the bottom segment-half of the mid-section segment 36, 39 of the snowman. This is where the mid-section segment and base segment of the snowman meet, and having flat surfaces of substantially the same size (especially, preferably, of a significant size) can lead to the mid-section segment sitting more securely on the base segment and/or it can lead to a more aesthetically pleasing finish.

In the example, because the mid-section segment and head segment are smaller than the base segment, when the bottom half-segment of the mid-section segment is made, it may be possible to tilt the bowl element 12, 15 to slide the mid-section bottom half-segment out, directly onto the base segment. The top half-segment of the mid-section segment could either then be released directly onto the bottom half-segment, or released separately, and then placed on the bottom half-segment. So the same for the bottom half-segment (and top half-segment) of the head segment onto the mid-section segment. Alternatively, the or each segment (or bottom half-segment) of the mid-section and head may be released (and even have the whole segment created) separately, and then stacked onto the snowman segment it is intended to be stacked on, (after having been released from the bowl element used to make it).

Referring still to FIG. 7, there is shown an example snowman that has been made with the apparatus. It can be seen that any imperfections/portions 38 where the segment-halves meet have been smoothed off, creating a perfect looking snowman. The mid-section segment is shown having been stacked on the base segment. The head segment is shown having been stacked on the mid-section segment.

It will be obvious, the snowman may be made using the apparatus, in a variety of orders of construction. For example, the user may first concentrate on the base segment, making the base segment fully, before moving onto the mid-section segment, before then moving onto the head segment. However, there are many permutations/orders of how the snowman can be constructed. For example, the user(s) could make the bottom segment-half of each snowman segment first, and only then start making the top segment-halves for the already made bottom segment halves, then constructing the snowman. Thus any order can be undertaken. It is even feasible the user(s) may make all the bottom segment-halves, release them, and make all the top segment halves (whether upturned yet or not), before even starting to construct the snowman.

Similarly, when stacking the bottom segment-half of the mid-section onto the base segment, the user may choose to release the bottom segment-half directly onto the base segment that has already been constructed, or may release the bottom segment-half first (e.g. onto the ground surface/snow), and then lift the bottom segment-half onto the base segment. The user could even, potentially, construct the whole mid-section segment separately (away from the base segment), and then lift the whole mid-section segment onto the base segment, thus stacking it. So the same (as described in this, or any other, paragraph) can be done for the head segment onto the mid-section segment. (Similarly the top segment-half of any segment may be released directly onto the bottom segment-half of that segment, or may be released away from the bottom segment-half (e.g. released, facing up for example, on the ground surface/snow), and then lifted (and turned upside down) to go onto the bottom segment-half, which, if the segment in question is not the base segment, may, or may not, already be stacked as part of the snowman).

Thus many permutations/orders can be carried out for how to construct the snowman, using the apparatus.

It is feasible the collected snow, once formed in the bowl element into a semi-spherical shape, may be left for an amount of time (e.g. several minutes), which may help the snow set better (especially if the snow is dry and very cold).

If the aperture 16 of the bowl element 12 for the head segment 36, 41 is smaller than the aperture 16 of the howl element 12 for the segment (e.g. mid-section segment) that the head segment 36, 41 is placed on, snow can be added onto the top segment-half of the mid-section segment (or generally about the area where the head segment and mid-section (or other)segment meet) so that the flat surface 34 at a top of the mid-section (or other) segment, and flat surface 34 at a bottom of the head segment match more closely, and/or snow can be added to generally make this area more aesthetically pleasing and/or smoothened.

Various accessories can then be placed on the snowman. These accessories may even make the 'snowman' into a 'snowwoman', which is considered within a scope of the term 'snowman', for the sake of the present application. There are shown a variety of snowman accessories in FIG. 8, any or all of which may be provided as part of the apparatus. There is shown: an example hat 40; an example eyes 42; an example nose 44 (preferably a typical snowman 'carrot-type' nose); an example arms and/or hands 46, (which are preferably shaped like and/or made out of twigs, as shown); an example mouth 48, and an example buttons 50. All these accessories are shown provided on the snowman shown in FIG. 7. An example scarf 52 is also shown on the snowman, which may also be provided as part of the apparatus/kit.

Preferably the (or any of the) accessories comprise a means 54 to facilitate attachment to the snowman. The term 'means' here includes with its scope any means under the Sun. In the examples shown (in FIG. 8), this is provided by way of a protrusion(s), which protrudes from some of the accessories. This can be used to stick into the snowman, thus holding the accessory in place. The protrusion shown may be defined as a peg, since it pegs the accessory(s) to the snowman. Thus it can be seen that such a means is usable to peg the accessory(s) of FIG. 7 to the snowman.

Figure 9:
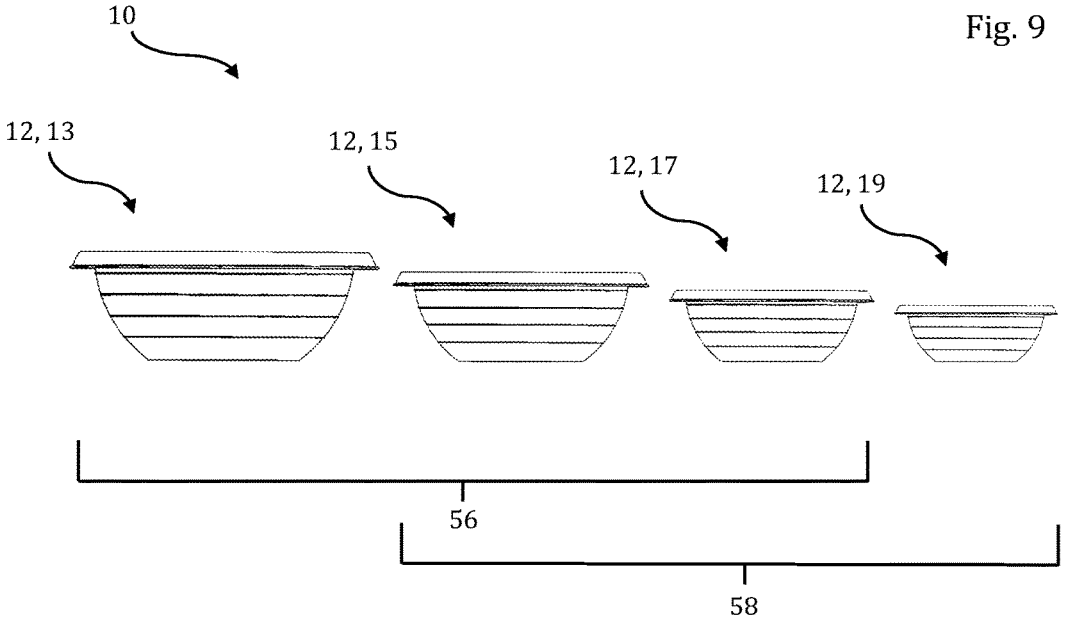
FIG. 9 shows an embodiment of the apparatus comprising four said bowl elements, which may be useful for creating snowmen of different sizes.

There is shown in FIG. 9 an embodiment of the apparatus wherein the apparatus 10 comprises four bowl elements 12. In the example, there is a fourth, smaller bowl element 12, 19. Having four bowl elements in this way may be useful, because bowl element 12, 13, bowl element 12, 15, and bowl element 12, 17 can be used to make a large snowman, and bowl element 12, 15, bowl element 12, 17, and bowl element 12, 19 can he used to make a smaller snowman. Thus, in the example, the largest three bowl elements (numbered 13, 15, 17) form what could be defined as a large snowman making combination 56, whilst bowl element 12, 15, bowl element 12, 17 and bowl element 12, 19 form what could be defined as a small snowman making combination 58. It is feasible a different combination of the bowl elements 12 could be used (e.g. bowl elements numbered 13, 17, and 19 could be used together, to form a snowman) or even that all four (or more) bowl elements may be used to make a snowman with more than three segments. However, it is thought using the three largest bowl elements to form a large snowman, and the three smallest bowl elements to form a smaller snowman, may be a particularly good use of (and/or may be particularly useful for) an embodiment that comprises four bowl elements 12.

It will be obvious the apparatus 10 may comprise even more than four bowl elements, and may comprise any number of bowl elements. This could allow for more than two different sized snowmen to be made using the apparatus, and could allow for a vast array of different size snowmen to be made. The apparatus/bowl element(s) could be provided in any size, to make a snowman of any size, although a main intent (i.e. in a preferred embodiment) is to make a snowman that is substantially life-sized.

The apparatus can be easily stored, or put away; if there are provided a plurality of bowl elements, they can be placed/fitted into each other, thus providing relatively low storage space requirements. For example, in FIG. 1, bowl element 12, 17 can be placed/fitted into bowl element 12, 15, and bowl element 12, 15 can be placed/fitted into bowl element 12, 13. Thus preferably no added space is required for storage, other than the size of the biggest bowl element. Thus it could be said that the bowl elements can be concentrically stored one within another.

Method

According to an embodiment of the present invention, there is provided a method of making a snowman, comprising: filling a substantially hemi-spherical bowl element with snow, thus creating a first substantially hemi-spherical hemi-sphere of collected snow in the bowl element; releasing the first substantially hemi-spherical hemi-sphere of collected snow out of the bowl element; filling the substantially hemi-spherical bowl element with snow again, thus creating a second substantially hemi-spherical hemi-sphere of collected snow in the bowl element; releasing the second substantially hemi-spherical hemi-sphere of collected snow out of the bowl element; placing one of the substantially hemi-spherical hemi-spheres of collected snow, faced downwards, on top of the other substantially hemi-spherical hemi-sphere of collected snow, the other substantially hemi-spherical hemi-sphere of collected snow being faced upwards, thus creating a substantially spherical snowman segment.

Preferably the first substantially hemi-spherical hemi-sphere of collected snow is released, faced upwards, and the second substantially hemi-spherical hemi-sphere of collected snow, (preferably having been released), is placed downwards, on top of the first substantially hemi-spherical hemi-sphere of collected snow.

Releasing and placing of the second substantially hemi-spherical hemi-sphere of collected snow (or whichever substantially hemi-spherical hemi-sphere of collected snow is stacked, faced downwards, on top of the other substantially hemi-spherical hemi-sphere) may feasibly be done in one action, although preferably the second substantially hemi-spherical hemi-sphere of collected snow (or whichever substantially hemi-spherical hemi-sphere of collected snow is stacked, faced downwards, on top of the other substantially hemi-spherical hemi-sphere)is released, and then placed/positioned, upside down (i.e. faced downwards), on the first/other substantially hemi-spherical hemi-sphere of collected snow.

According to the second aspect, the bowl element is not required to have an aperture at a base of the bowl element. Snow may simply be inputted into the bowl element in any way. Thus snow can be inputted into the bowl element via the open top of the bowl element.

All feature(s) and/or disclosure and/or step(s) disclosed relating to the first aspect may be provided/afforded to (and claimed) with reference to the second aspect (method). Thus the bowl element, according to the second aspect (method), may comprise ribbing, etc., and may comprise any of the feature(s) and/or disclosure and/or step(s) as set out regarding the first aspect.

Preferably the same method is carried out, using a plurality of said bowl elements of differing sizes, to create different sized snowman segments, the method of making a snowman further comprising stacking the segments.

Preferably the same method is carried out, using three said bowl elements of differing sizes, there being a large size bowl element to form a base segment of the snowman; a mid-size bowl element to forma mid-section segment of the snowman; and a small size bowl element to form a head segment of the snowman.

Preferably the method further comprises stacking the mid-section segment onto the base segment, and stacking the head segment onto the mid-section segment.

Although the second aspect (method) does not require the bowl element(s) to comprise an aperture at a base of the bowl element(s), preferably the or each bowl element comprise an aperture at a base of the or each bowl element to facilitate collection of snow in the or each bowl element, via dragging the or each bowl element over a surface of snow, the method thus further comprising dragging the or each bowl element over a surface of snow to collect snow in the or each bowl element.

According to the method, preferably the bowl element(s) is shaped (e.g. with an aperture 16 at the base, or simply having a flat base) so that the substantially hemi-spherical segments created have a flat surface 34, which helps stacking.

In short, according to the second aspect, a method is provided much as set out with regard to the first aspect, but not requiring the bowl element(s) to have an aperture at the base, to facilitate collection of snow. It is thought this method of making snowman segment(s) and/or a snowman, even without the aperture, is novel and inventive.

As stated, all feature(s) and/or disclosure and/or step(s) as disclosed regarding the first aspect may be afforded to (and claimed with reference to) the second aspect, and vice versa. Thus the method may further comprise, for example, applying accessories to a snowman that has been created using the method.

The embodiments described above are provided by way of example only, and various other modifications will be apparent to persons skilled in the art without departing from the scope of the invention as defined in the appended claims.

The invention claimed is:

1. A snowman making apparatus comprising: three bowl elements of different sizes, wherein the three different sizes are for three different segments of a snowman, a base segment, a mid-section segment and a head segment;

wherein each bowl element is substantially hemispherical;

wherein each bowl element has an open top, and an aperture at a base of the bowl element to facilitate collection of snow in the bowl element, via dragging the bowl element in a horizontal position over a surface of snow, producing a formed hemisphere snow section;

the bottom aperture of the base segment and mid-section segment are substantially the same size in order to create a stable setting for the mid-section segment to sit securely on to the base segment as well as the base section to sit securely on to the ground;

the hemispherical bowl element interior is smooth for easy release of the formed hemisphere snow section;

the hemispherical bowl element exterior comprises a plurality of circumnavigating ribs, to add structural strength to the bowl element;

the apparatus is provided a fourth, smaller bowl element in order to form smaller size and combinations of snowmen.

2. A snowman making apparatus as claimed in claim 1, wherein each substantially hemispherical bowl element comprises a handle to aid dragging of the bowl element over the surface of snow.

3. A snowman making apparatus as claimed in claim 1, wherein an edge of each bowl element comprises a rim, to aid dragging of the bowl element over the surface of snow.

4. A snowman making apparatus as claimed in claim 3, wherein the rim extends round a whole circumference of the bowl element.

5. A snowman making apparatus as claimed in claim 3, wherein the apparatus comprises a support arrangement for supporting the rim.

6. A snowman making apparatus as claimed in claim 1, wherein the apparatus further comprises one or more snowman accessories.

7. A snowman making apparatus as claimed in claim 6, wherein any of the said accessories comprises a means to facilitate attachment to a snowman.

8. A snowman making apparatus as claimed in claim 7, wherein the means to facilitate attachment to a snowman comprises a protrusion.

9. A snowman making apparatus as claimed in claim 8, wherein the protrusion comprises a peg.

* * * * *